US008231175B2

(12) United States Patent
Aminian

(10) Patent No.: US 8,231,175 B2
(45) Date of Patent: Jul. 31, 2012

(54) DYNAMIC ORTHOPAEDIC CHAIR

(76) Inventor: Afshin Aminian, Orange, CA (US)

( * ) Notice: Subject to any disclaimer, the term of this patent is extended or adjusted under 35 U.S.C. 154(b) by 103 days.

(21) Appl. No.: 12/759,446

(22) Filed: Apr. 13, 2010

(65) Prior Publication Data

US 2010/0259083 A1 Oct. 14, 2010

Related U.S. Application Data

(60) Provisional application No. 61/168,805, filed on Apr. 13, 2009.

(51) Int. Cl.
*A47C 1/032* (2006.01)

(52) U.S. Cl. ..... 297/314

(58) Field of Classification Search ..... 297/314
See application file for complete search history.

(56) References Cited

U.S. PATENT DOCUMENTS

| | | | | | |
|---|---|---|---|---|---|
| 30,706 | A | * | 11/1860 | Vleck | 297/314 |
| RE7,687 | E | * | 5/1877 | Morrison | 297/314 |
| RE8,389 | E | * | 8/1878 | Whitcomb | 297/314 |
| 468,398 | A | * | 2/1892 | Sherman | 297/314 X |
| 605,527 | A | * | 6/1898 | Schwartz | 297/314 X |
| 612,580 | A | * | 10/1898 | Banes | 108/2 |
| 619,596 | A | * | 2/1899 | Mayer | 248/398 |
| 659,532 | A | * | 10/1900 | Jordan | 108/8 |
| 750,577 | A | * | 1/1904 | Bostwick et al. | 114/194 |
| 1,194,551 | A | * | 8/1916 | Schossler | 108/2 |
| 1,429,979 | A | * | 9/1922 | Spanenberg | 297/314 X |
| 2,048,148 | A | * | 7/1936 | Stoll | 248/583 |
| 2,571,443 | A | * | 10/1951 | Hair | 248/397 |
| 2,719,571 | A | * | 10/1955 | Taylor | 297/314 X |
| 2,808,828 | A | * | 10/1957 | Salem | 601/90 |
| 2,920,685 | A | * | 1/1960 | Trebilcock | 297/314 |
| 3,975,051 | A | | 8/1976 | Ballagh | |
| 4,099,697 | A | * | 7/1978 | Von Schuckmann | 297/314 X |
| 4,214,790 | A | | 7/1980 | Sieber | |
| 4,236,752 | A | * | 12/1980 | Mizelle | 297/302.3 |
| 4,295,683 | A | | 10/1981 | Dubbink et al. | |
| RE31,092 | E | | 11/1982 | Sieber | |
| 4,362,334 | A | | 12/1982 | Ross et al. | |
| 4,605,334 | A | * | 8/1986 | Kalvatn | 297/314 X |
| 4,647,066 | A | | 3/1987 | Walton | |
| 4,659,053 | A | * | 4/1987 | Holley et al. | 248/663 |
| D291,155 | S | | 8/1987 | Wertheimer | |
| 4,778,217 | A | | 10/1988 | Lane | |
| 4,793,652 | A | | 12/1988 | Hannah et al. | |
| 4,807,841 | A | * | 2/1989 | Edstrom | 248/580 |
| 4,824,169 | A | | 4/1989 | Jarrell | |
| 4,872,223 | A | | 10/1989 | Baird | |
| 4,887,865 | A | | 12/1989 | Dawidzon | |
| 4,907,303 | A | | 3/1990 | Baird | |
| D307,221 | S | | 4/1990 | Mudge | |
| 4,974,904 | A | * | 12/1990 | Phillips et al. | 297/258.1 |
| 5,022,708 | A | * | 6/1991 | Nordella et al. | 297/327 |
| 5,044,587 | A | * | 9/1991 | Degen | 248/158 |

(Continued)

*Primary Examiner* — Rodney B White
(74) *Attorney, Agent, or Firm* — Kauth, Pomeroy, Peck & Bailey LLP

(57) ABSTRACT

An orthopaedic chair that requires a seated person to actively and dynamically support their upper bodies while seated is provided. The chair is designed such that the core musculature of the seated person must be actively engaged while in a seated position. To accomplish this, the chair is provided with an unstable or dynamic seating platform, i.e., a seating platform which is independently movable in several dimensions such that to stabilize the seating platform the musculature of the body, and in particular the core, must be utilized.

17 Claims, 2 Drawing Sheets

U.S. PATENT DOCUMENTS 5,297,850 A 3/1994 Guleserian
5,383,709 A 1/1995 Chaney et al.
5,409,295 A * 4/1995 Edstrom ..... 297/314
5,494,332 A 2/1996 Daniel
5,590,930 A * 1/1997 Glockl ..... 297/313
5,690,389 A * 11/1997 Ekman et al. ..... 297/452.41
5,728,049 A * 3/1998 Alberts ..... 297/314 X
5,735,571 A 4/1998 Colondona
5,863,282 A 1/1999 Moossun
5,887,951 A 3/1999 Willingham
6,059,365 A 5/2000 Diamond
6,123,390 A 9/2000 Greenwald
6,159,172 A 12/2000 Gray et al.
6,176,548 B1 * 1/2001 Thole et al. ..... 297/302.1
6,209,958 B1 * 4/2001 Thole ..... 297/302.1
6,520,578 B1 * 2/2003 Jospa et al. ..... 297/217.1
6,702,388 B1 * 3/2004 Chiu ..... 297/452.41
6,832,817 B1 * 12/2004 Chiu ..... 297/452.41
6,863,017 B2 * 3/2005 Charles et al. ..... 297/314 X
7,044,542 B2 * 5/2006 Muscat ..... 297/215.15
7,044,558 B2 * 5/2006 Chiu ..... 297/452.41
7,063,386 B2 * 6/2006 Dowty et al. ..... 297/314 X
7,100,983 B1 * 9/2006 Gant ..... 297/314
7,547,067 B2 * 6/2009 Keilhauer et al. ..... 297/314 X
7,789,463 B2 * 9/2010 Gang ..... 297/314
7,938,489 B2 * 5/2011 Nazari ..... 297/314
8,029,060 B2 * 10/2011 Parker et al. ..... 297/314 X
2002/0043846 A1 * 4/2002 Brauning ..... 297/314
2005/0173952 A1 * 8/2005 Van Der Laan ..... 297/314 X
2009/0230743 A1 * 9/2009 Derakhshan et al. ..... 297/329
2009/0261641 A1 * 10/2009 Dickie ..... 297/314

* cited by examiner

DYNAMIC ORTHOPAEDIC CHAIR

CROSS-REFERENCE TO RELATED APPLICATION

The current application claims priority to U.S. Provisional Application No. 61/168,805, filed Apr. 13, 2009, the disclosure of which is incorporated herein by reference.

FIELD OF THE INVENTION

This invention relates generally to a novel orthopaedic chair; and more particularly to a functionally dynamic orthopaedic chair with an unstable or active seating platform.

BACKGROUND OF THE INVENTION

Over the past five to six years there has been a marked increase in the number of spinal surgeries performed in the United States. One reason for this increase is that the modern lifestyle is, for the most part, sedentary. In particular, the lifestyles of day-to-day workers and even children now revolve around seated activities, such as, for example, watching TV, using computers, playing video games, etc. Indeed, in the office setting the advent of email communication makes face-to-face interaction and movement around the office unnecessary. As a result, many office workers spend the majority of their working day in a seated position.

It is well-established that stresses on the human body are best balanced and borne by the spine when a person is in a standing position. When seated more stress is applied to the spine and particularly the lower lumbar spine. This added stress leads to excessive wear and tear on these lower areas of spine, and increased and early degeneration of spine. Indeed, recent literature reports have indicated that the incidence of back pain in adolescent children is as high as 60%.

To address the rising and chronic spinal degeneration caused by sitting, many companies have introduced chairs that have purported therapeutic orthopaedic benefits. And, indeed, many of these chairs do provide superior back support and improved seating posture. However, while these chairs can improve back posture and position they are passive, that is these chairs support the back such that the seated person is not required to exert the musculature in the back to support their upper bodies. The result is that regardless of how these chairs "support" the back, prolonged use will lead to weakening of the supportive musculature, which in turn means that all of the stress generated by the head, torso and upper extremities will be translated directly to the lower lumber vertebral bodies at their connection to the sacrum.

Accordingly, a need exists for a new class of chair that is functionally dynamic such that the musculature of the back is actively engaged in supporting a person's upper body while in a seated position.

BRIEF SUMMARY OF THE INVENTION

Thus, there is provided in accordance with the current invention a functionally dynamic orthopaedic chair designed to engage the muscles in the back and abdomen to actively support the upper body of a seated portion.

In one exemplary embodiment, the orthopaedic chair of the current invention provides an unstable seating platform.

In another embodiment, the orthopaedic chair includes a base portion designed to stably engage the floor and an unstable seating portion designed to movably engage the base portion.

In still another embodiment, the unstable seating portion may be at least partially formed of a partial hemisphere that movably sits within a cooperative hemispherical bowl or depression in the top of the base portion such that the unstable seating portion may rotate and pivot freely within the base portion. In such an embodiment, the cooperative surfaces of the base portion and the seating portion of the chair are surface treated with a material having a low coefficient of friction, such as a metallic surface coated with a gel or other lubricant. In another such embodiment, the unstable seating platform is provided with a retaining rim to limit the movement of the seating platform in any direction.

In yet another embodiment, the unstable seating platform may removably rest within the base portion or may be attached or tethered to the base portion.

In still yet another embodiment, the unstable seating platform comprises an elongated body having a partially hemispherical portion designed to cooperatively engage the base of the chair and a seating portion at the other end. In such an embodiment, the body of the chair is designed such that it has an elongated vertical axis thereby providing an unstable seating platform that requires optimal alignment of the spine while the person is seated.

In still yet another embodiment, the seating surface of the unstable seating platform is formed as a partial hemisphere.

In still yet another embodiment, the chair further comprises an elongated armature designed to engage the lower back in a non-supportive manner as a lumbar reminder.

In still yet another embodiment, the chair furthers includes arm supports.

In still yet another embodiment, the various components of the chair are adjustable such that seating position may be tailored to fit the specific height and body shape of the user. In such an embodiment, for example, one or more of the seating platform, lumbar reminder and arm supports may be adjusted in one or more dimensions.

BRIEF DESCRIPTION OF THE DRAWINGS

The description will be more fully understood with reference to the following figure, which is presented as an exemplary embodiment of the invention and should not be construed as a complete recitation of the scope of the invention, wherein.

DETAILED DESCRIPTION OF THE INVENTION

The current invention is directed to a functionally dynamic orthopaedic chair designed to engage the muscles in the back and abdomen to actively support the upper body of a seated portion. The orthopaedic chair of the current invention is based on the observation that the only structure connecting a person's upper extremity to their pelvis is the musculature in the core of the body (e.g., abdominal, glutei and Para spinal muscles) and the spine. If the musculature of the body is not engaged in supporting the upper extremities, then all of the stress exerted by the upper extremities will be translated through the spine, and specifically through the lower lumbar vertebral bodies at their connection to the sacrum. This in turn can create excessive wear and tear on these vertebral bodies and can lead to early degeneration of the lower lumbar spine.

The orthopaedic chair of the current invention addresses this issue by requiring that a seated person actively and dynamically support their upper bodies while seated. In other words, the chair of the current invention is designed such that the core musculature must be actively engaged while seated. To accomplish this, the chair of the invention is provided with an unstable or dynamic seating platform, i.e., a seating platform which is independently movable in several dimensions such that to stabilize the seating platform the musculature of the body, and in particular the core, must be utilized.

Figure 1:
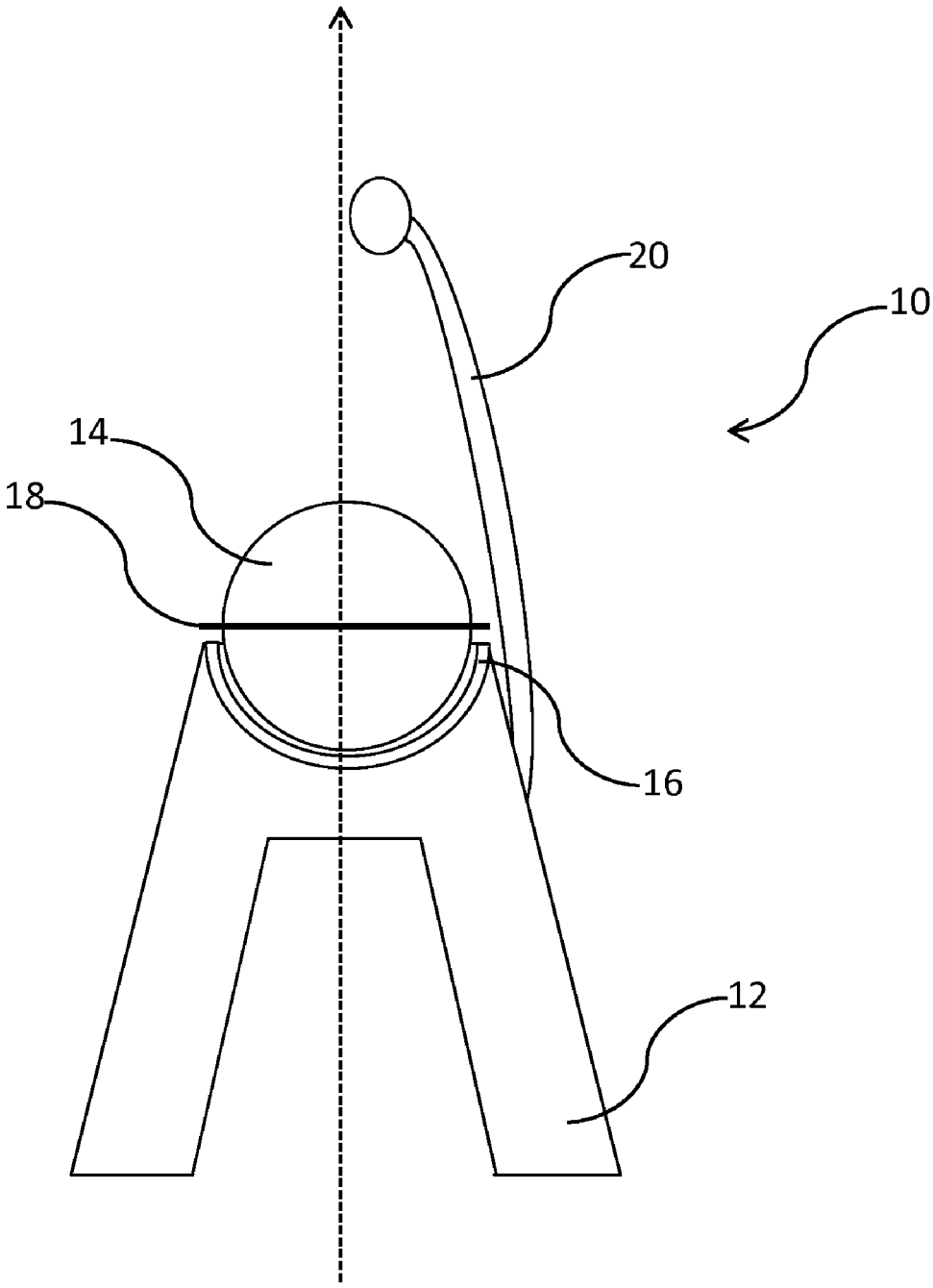
FIG. 1 provides a schematic of an exemplary embodiment of an orthopaedic chair in accordance with the current invention.

FIG. 1 provides a schematic diagram of one exemplary embodiment of an orthopaedic chair in accordance with the current invention. As shown, the chair (10) generally comprises a base portion (12), which provides a stable connection to the floor, and an unstable or dynamic seating platform (14). In this embodiment, the dynamic seating platform (14) is formed as a hemisphere that movably sits within a cooperative hemispherical bowl. (16) or depression in the top of the base such that the dynamic seating portion may rotate and pivot freely within the base portion in any direction. Although the base and seating platform of the chair may be made of any suitable material, such as, for example, wood, metal, plastic, etc., in this embodiment of the chair the cooperative surfaces of the base portion and the seating portion of the chair are preferably made of or surface treated with at least one material having a low coefficient of friction to improve the mobility of the seating platform relative to the chair base. For example, in one exemplary embodiment, the cooperative surfaces of the seating platform and the chair base are made of a metallic or plastic material and are further coated with a gel or other lubricant.

The top surface of the seating platform (14), i.e., the portion of the seating platform on which the user sits is shown in FIG. 1 as also taking the form of a hemisphere. Although such an arrangement does enhance the dynamic action of the chair, it should be understood that any seating surface may be used such that it may be incorporated with the dynamic seating platform base. For example, the seat may take the form of a standard contoured, padded leather or cloth cushion seat attached atop the hemispherical seating platform base shown in FIG. 1.

Although the above discussion has focused on the top and bottom surfaces of the seating platform and their engagement with the base of the chair, another element of the chair, as shown in FIG. 1, is a safety retaining element (18) to prevent excessive movement between the seating platform and the base. In the embodiment shown in FIG. 1, this safety retaining element takes the form of a rim that runs about the circumference of the hemispherical seating platform and overlaps the base of the chair to limit the extent of movement of the seating platform relative to the base. Although a circumferential rim is shown in FIG. 1, it should be understood that this safety retaining element may take other forms, such as a plurality of tabs, pins or other projections set at intervals around the circumference of the seating platform or the cooperative platform (16) of the base (12) of the chair. Alternatively, the seating platform could be tethered or otherwise attached to the base of the chair externally or internally to prevent excessive movement. Such a tether may also prevent removal of the seating platform from the base of the chair if desired.

Although one exemplary embodiment of such an unstable platform is discussed above, and with regard to the exemplary embodiments below, it should be understood that the current invention contemplates that the unstable platform may take any form such that the musculature of the core of the body is actively engaged to maintain a neutral seating position and that the movement of the seating platform is constrained to prevent the user from falling off the platform.

In addition to the core elements of base and dynamic seating platform, the chair of the current invention may also include a number of other optional structures. For example, in the embodiment shown in FIG. 1, the chair further comprises an elongated armature (20) attached to the base portion of the chair and designed to engage the lower back in a non-supportive manner as a lumbar reminder. Although one form of such a lumbar reminder is shown in the figure, it should be understood that the lumbar reminder may take the form of any non-supportive armature or element suitable to help maintain proper posture by preventing the seated person from slouching. In another embodiment, the chair may further include arm rests (not shown) similarly attached to the stable base of any shape or size suitable to provide support for the seated person's arms.

Although the above discussion has focused on fixed elements, it should be understood that the various components of the chair are adjustable such that seating position may be tailored to fit the specific height and body shape of the user. In such an embodiment, for example, one or more of the seating platform, lumbar reminder and arm supports may be adjusted in one or more dimensions to provide a better seating position for the user.

EXEMPLARY EMBODIMENTS

The person skilled in the art will recognize that additional. embodiments according to the invention are contemplated as being within the scope of the foregoing generic disclosure, and no disclaimer is in any way intended by the foregoing, non-limiting examples.

FIG. 1 provides one exemplary embodiment of the invention. In this embodiment, the chair takes the form of two separate pieces, a stable base platform (12) and a dynamic/unstable seating platform (14). In this embodiment, the unstable seating platform takes the form of a hemispherical ball with bottom and top halves separated by a retaining safety ring (18). In this embodiment, the bottom half of the hemispherical ball rests within and engages a cooperative hemispherical bowl. (16) or depression formed in the top surface of the base of the chair. The surfaces of the bottom half of the hemispherical seating platform and hemispherical depression are formed with a metalized surface, and preferably the metalized surface are coated with a low coefficient of friction gel or lubricant material. The retaining safety ring runs (18) around the circumference of the hemispherical seating platform and is dimensioned to overlap the edge of the chair base to limit the movement of the seating platform in any dimension.

In addition to the chair base and dynamic seating platform, the embodiment shown in FIG. 1 further includes an elongated armature connected (20) through the chair base and dimensioned to rest against a seated person's lower back to provide a lumbar posture reminder. Finally, it is noted that in the embodiment shown, both the base and lumbar reminder are preferably adjustable to ensure the user may assume an optimal seating position.

Figure 2:
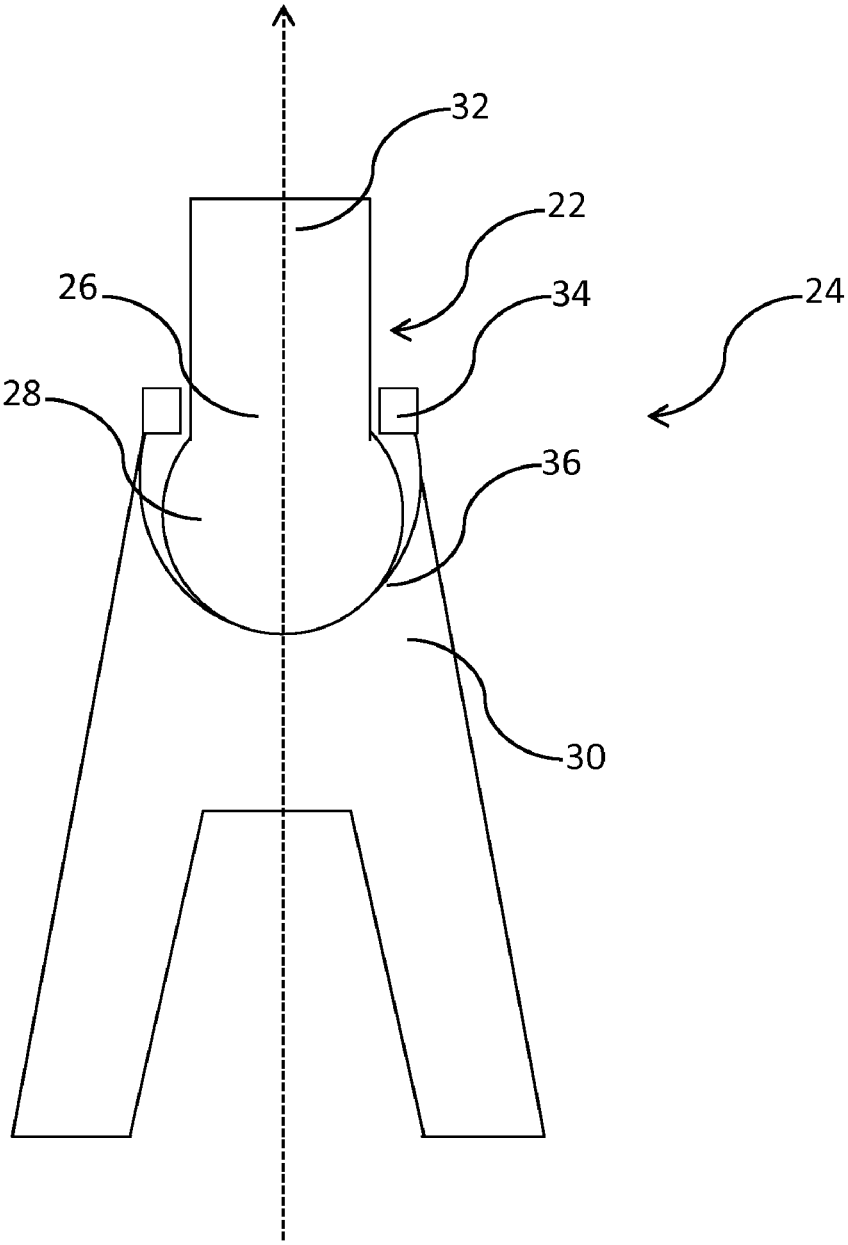
FIG. 2 provides a schematic of a second exemplary embodiment of an orthopaedic chair in accordance with the current invention.

FIG. 2 provides a second exemplary embodiment of the invention. In this embodiment, the dynamic/unstable seating platform (22) of the chair (24) comprises an elongated vertical body (26) having a hemispherical portion (28) at one end that sits in cooperative engagement with the top of the base portion (30) of the chair, and a seating portion (32) at the other end. This elongated design requires that not only must the person actively use their muscles to balance, but that the alignment of the spine also be maintained in an optimal alignment. In this embodiment, the retaining safety element is a ring (34) that runs about the circumference of the cooperative hemispherical bowl (36) of the base portion of the chair such that the movement of the seating platform in any dimension is limited to prevent the seating platform from tipping over. It is noted that in the embodiment shown, the base (30) is preferably adjustable to ensure the user may assume an optimal seating position. In addition, the embodiment shown in FIG. 2 may also incorporated back and arm posture supports as described previously.

DOCTRINE OF EQUIVALENTS

Those skilled in the art will appreciate that the foregoing examples and descriptions of various preferred embodiments of the present invention are merely illustrative of the invention as a whole, and that variations in the steps and various components of the present invention may be made within the spirit and scope of the invention. For example, it will be clear to one skilled in the art that additional alternative configurations or other elements would not affect the improved properties of the orthopaedic chair of the current invention nor render the chair unsuitable for its intended purpose. Accordingly, the present invention is not limited to the specific embodiments described herein but, rather, is defined by the scope of the appended claims.

What is claimed is:

1. A functionally dynamic orthopaedic chair comprising:

a dynamic seating platform having top and bottom surfaces and having a vertical axis passing therethrough, wherein the bottom surface is defined by an outer edge and is hemispherical;

a base portion having upper and lower ends, and a receiving element disposed in said upper end and being defined by an outer edge and configured as a hemispherical bowl cooperative with said bottom surface of said dynamic seating platform such that the bottom hemispherical surface of the dynamic seating platform and the hemispherical bowl of the receiving element are in direct movable contact theretogether, and wherein the dynamic seating platform is otherwise not interconnected with said receiving element;

a retaining element disposed about the outer edge of one of at least one of either the receiving element and the base portion such that the retaining element engages the outer edge of said dynamic seating platform from pivoting beyond a pre-designated number degrees past horizontal thereby preventing further movement in said direction; and wherein the dynamic seating platform is capable of pivoting within said receiving element in any direction about its vertical axis such that a user must actively engage the muscles in the back and abdomen to support the upper body when seated on the top surface of said dynamic seating platform.

2. The chair of claim 1, wherein the lower end of the base portion is designed to stably engage the floor.

3. The chair of claim 1, wherein the hemispherical bowl of the upper end of the receiving element and the hemisphere of the bottom surface of the dynamic seating platform are surface treated with a material having a low coefficient of friction.

4. The chair of claim 3, wherein the material is selected from the group consisting of a metallic coating, a polymeric materials and a lubricant.

5. The chair of claim 1, wherein the retaining element is a rim disposed about the dynamic seating platform between the top and bottom surfaces thereof such that the rim engages the outer edge of the receiving element.

6. The chair of claim 1, wherein the retaining element is a rim disposed about the outer edge of the of the receiving element such that the rim engages the a portion of the dynamic seating platform.

7. The chair of claim 1, wherein the dynamic seating platform is moveably interconnected with the base portion.

8. The chair of claim 1, wherein the top surface of said dynamic seating platform comprises a partial hemisphere.

9. The chair of claim 1, wherein the height of the dynamic seating platform in relation to the floor is adjustable.

10. The chair of claim 1, further comprising arm supports interconnected to said base portion.

11. The chair of claim 1, wherein the position of said arm supports relative to said dynamic seating platform is adjustable.

12. The chair of claim 1, further comprising a lumbar reminder interconnected to said base portion.

13. The chair of claim 12, wherein the position of said lumbar reminder relative to said dynamic seating platform is adjustable.

14. The chair of claim 1, wherein the dynamic seating platform comprises an elongated body such that said platform has an elongated vertical axis thereby requiring optimal alignment of the users spine while seated.

15. The chair of claim 14, wherein longated axis is longer of the dynamic seating platform is longer than the diameter of the hemispherical bottom end of the dynamic seating platform.

16. The chair of claim 15, wherein the seating portion is substantially flat.

17. A functionally dynamic orthopaedic chair comprising:

a dynamic seating platform defined by an elongated body having top and bottom wherein the elongated dimension lies along an elongated vertical axis of said body, wherein the bottom surface is defined by an outer edge and is hemispherical;

a base portion having upper and lower ends, and a receiving element disposed in said upper end and being defined by an outer edge and configured as a hemispherical bowl cooperative with said bottom surface of said dynamic seating platform and movably engaged therewith;

a retaining element disposed about the outer edge of one of at least one of either the receiving element and the base portion such that the retaining element engages the outer edge of said dynamic seating platform from pivoting beyond a pre-designated number degrees past horizontal thereby preventing further movement in said direction; and wherein the dynamic seating platform is capable of pivoting within said receiving element in any direction about its elongated vertical axis such that a user must actively engage the muscles in the back and abdomen to support the upper body and wherein the spine must be in optimal alignment when seated on the top surface of said dynamic seating platform.

* * * * *